US006371752B1

(12) United States Patent
Kuroda et al.

(10) Patent No.: US 6,371,752 B1
(45) Date of Patent: Apr. 16, 2002

(54) METHOD FOR CONTROLLING COMBUSTION OF A BURNER IN A BATCH-TYPE COMBUSTION FURNACE

(75) Inventors: Tsuyoshi Kuroda, Kuwana; Makoto Arai, Nagoya; Yasuhiro Ito, Nagoya; Yasushi Okumura, Nagoya, all of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/532,051

(22) Filed: Mar. 21, 2000

(30) Foreign Application Priority Data

Mar. 23, 1999 (JP) ..... 11-077477

(51) Int. Cl.[7] ..... F23C 7/00
(52) U.S. Cl. ..... 431/6; 431/12; 431/75
(58) Field of Search ..... 431/6, 12, 75, 431/89; 137/456

(56) References Cited

U.S. PATENT DOCUMENTS 4,498,863 A * 2/1985 Hanson et al. ..... 431/89
4,531,905 A * 7/1985 Ross ..... 431/12
4,676,734 A * 6/1987 Foley ..... 431/12
4,717,071 A * 1/1988 Capone ..... 431/12

FOREIGN PATENT DOCUMENTS

JP 57-175813 A * 10/1982 ..... 431/12
SU 1513319 * 10/1989 ..... 431/12

* cited by examiner

*Primary Examiner*—Sara Clarke

(57) ABSTRACT

A method for controlling the combustion of burners in a batch-type combustion furnace, includes the steps of electrically linking a where the fuel gas control valves are electrically linking to corresponding air control valves for each of the burners in a batch-type combustion furnace. The method includes the steps of preliminarily calibrating the air-fuel ratio adjusted with zero and span adjustments between the fuel gas control valve and the corresponding air control valve so as to give a theoretical air-fuel ratio when same electric signals are given to the fuel gas control valve and the air control valve. The next step is inputting an electric signal from a temperature controller to the fuel gas control valve, then adding an electric signal for adjusting an excess air volume to a same electrical signal as that for the fuel gas control valve, and finally inputting the resulting electric signal obtained by the above addition to the air control valve, wherein the combustion of each of the burners is controlled.

5 Claims, 5 Drawing Sheets

METHOD FOR CONTROLLING COMBUSTION OF A BURNER IN A BATCH-TYPE COMBUSTION FURNACE

BACKGROUND OF THE INVENTION (1) Field of the Invention

The present invention relates to a method for controlling combustion of burners in a batch-type combustion furnace, which method enables the combustion of each of the burners to be controlled, while always maintaining the combustion state of the burners at not less than a theoretical air-fuel ratio $\lambda=1$. [$\lambda$=(actual air volume)÷(air volume for the stoichiometric combustion of a given fuel gas volume)].

(2) Related Art Statement

In order to control the combustion of the burners in the batch-type combustion furnace, there are known two methods: (i) is a method using a pressure-equalizing valve and (ii) is a method of controlling a flow ratio between a fuel gas and air through independently measuring flow rates of the fuel gas and the air, respectively. Between them, according to the first method of using the pressure-equalizing valve method, as shown in FIG. 5, the pressure Pg of the fuel gas is always made equal to that of the Pa of the air in an air pipeline by a pressure-equaling valve 1 which is arranged in a fuel gas pipeline, and the respective flow rates of the fuel gas and the air are adjusted by throttle valves 2 and 3, respectively, so that the flow rate of the fuel gas may be in proportion to that of the air. Combustion is controlled by opening or closing an air control damper 5 with a temperature controller 4. When the air-fuel ratio is to be changed, a part of a loading pressure upon the pressure-equalizing valve 1 is released through a loading pressure release valve 6 thereby to increase the fuel-air ratio. In FIG. 5, a thermocouple 7 is connected to the temperature controller 4, and a combustion air blower 8 to the air control damper. A loading pressure program 9 is connected to the loading pressure release valve 6. A burner is denoted by 10.

Since in this method the controlling system can be relatively inexpensively constructed, it is suitable for independently controlling respective burners. However, since a variable range of the fuel gas pressure Pg is as small as 2 to 20 kPa due to the performance of the pressure equalizing-valve 1, the maximum air-fuel ratio "$\lambda$" is as small as around 4.0. Owing to this limitation, the above method is not suitable for the batch-type combustion furnace requiring the air-fuel ratio "$\lambda$" in a low temperature range to be controlled to 10 or more.

SUMMARY OF THE INVENTION

The present invention has been made to provide a method for controlling the combustion of burners in a batch-type combustion furnace where the method solves the conventional problems mentioned above, realizes controlling the air-fuel ratio "$\lambda$" to a high level of 10 or above, and is suitable when viewed from performance and price.

The present invention, which has been made to solve the above-mentioned problems, relates to a method for controlling each of the burners in a batch-type combustion furnace in which a fuel gas control valve is electrically linked to a corresponding air control valve. The method comprising the steps of preliminarily affecting a flow range ratio adjusted with zero and span adjustments between the fuel gas control valve and the corresponding air control valve so as to give a theoretical air-fuel ratio when equal electric signals are given to the fuel gas control valve and the air control valve.

The next step is inputting a first electric signal from a temperature controller to the fuel gas control valve to control an open degree of the fuel gas control valve, then adding an electric signal for adjusting an excess air volume to a second electrical signal equal to the first one for the fuel gas control valve to control an open degree of the air control valve, and finally inputting the resulting electric signal obtained by the above addition to the air control valve, wherein the combustion of each of the burners is controlled.

The excess air volume-adjusting electrical signal is preferably determined based on the content of oxygen inside the furnace and an excess volume of oxygen required in the furnace, which excess volume is a set valve at a given point of time of a time vs. firing temperature program. Further, it is preferable to control, at a constant level, the air pressure of an air source to supply combustion air to the air control valve. Further, it is preferable that if a trouble signal is outputted from the fuel gas control valve or the air control valve, the combustion of the burner is interrupted.

Since the present invention adopts the system in which the fuel gas control valve and the air control valve are electrically linked to control the combustion of each of the burners, the control system can be constructed inexpensively. Further, the zero span adjustment is preliminarily effected between the fuel gas control valve and the corresponding air control valve in such a manner as to give a theoretical air-fuel ratio when equal electric signals are given to the fuel gas control valve and the air control valve, respectively. Then in operation the electric signal obtained by adding the electric signal for adjusting an excess air volume to the electrical signal equal to that for the fuel gas control valve is inputted to the air control valve. Accordingly, the air-fuel ratio can be electrically and arbitrarily controlled.

BRIEF DESCRIPTION OF THE DRAWINGS

For a better understanding of the invention, reference is made to the attached drawings, wherein.

DETAILED DESCRIPTION OF THE INVENTION

In the following, a specific embodiment of the present invention will be explained.

Figure 1:
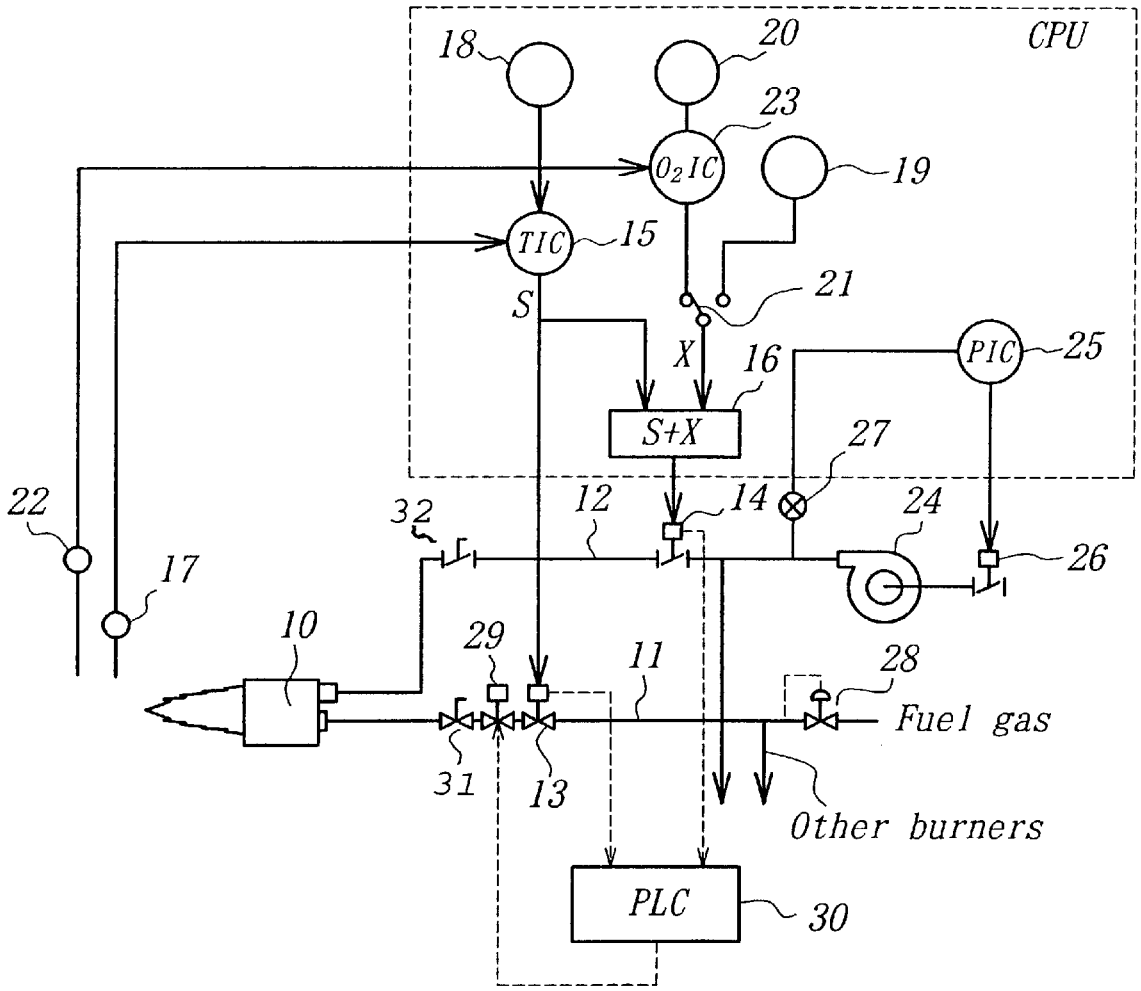
FIG. 1 is a systematic control diagram of a specific embodiment of the present invention.

In FIG. 1, a burner 10 is arranged in a batch-type combustion furnace not shown, and a fuel gas pipeline 11 and an air pipeline 12 are connected to the burner 10. A fuel gas control valve 13 is provided in the fuel gas pipeline 11 along with a fuel gas valve 31, and an air control valve 14 is in the air pipeline 12 along with an air valve 32.

A temperature controller 15 is connected to the fuel gas control valve 13, and also connected to the air control valve 14 through an adder 16. A thermocouple 17 for measuring the temperature in the furnace and a firing program generator 18 are connected to the temperature controller 15.

An excess air setting program generator 19 and an oxygen concentration program generator 20 are connected to the adder 16 via a switch 21. An oxygen analyzer 22 is arranged in the furnace (not shown) and is connected to an oxygen concentration controller 23 which is arranged between the oxygen concentration program generator 20 and the switch 21. Although shown separately in FIG. 1, the firing program generator 18, the excess air setting program generator 19, and the oxygen-concentration program generator 20 are included in a CPU shown in FIG. 1 by a dotted line.

A combustion air blower 24 is arranged at an upstream end of the air pipeline 12, and is connected to an pneumatic pressure controller 25 via a suction control damper 26. The pneumatic pressure controller 25 is connected to the air pipe line 12 downstream from the blower 24 via a pressure sensor 27. In FIG. 1, reference numerals 28, 29 are a fuel gas regulator and a shut-down valve, respectively, and a reference numeral 30 denotes a PLC (Programmable logic controller) into which electric signals (trouble signals) are inputted from the fuel gas control valve 13 and the air control valve into the PLC, while a shut-down signal is outputted from the PLC to the shut down valve 29. In FIG. 1, the fuel gas pipeline is branched to feed other burner(s), whereas the air pipeline 12 is also branched to feed air to other burner(s).

An electric signal S is directly inputted to the fuel gas control valve 13 from the temperature controller 15. As to the air control valve 14, an equal electric signal S from the temperature controller 15 is added with another electric signal X from an adder 16 for adjusting an excess volume of air, and an electric signal obtained by this addition is added to the air control valve 14. The fuel gas control valve 13 and the air control valve 14 are preliminarily adjusted to such a flow range ratio with zero and span adjustments that when the equal electric signals S are given to the control valves, respectively, a mixed gas of air and the fuel gas is fed so that the combustion may be affected in the burner at the theoretical air-fuel ratio. Therefore, if the electric signal X for the adjustment of the excess air amount is zero, the burner effects combustion at the theoretical air-fuel ratio.

Figure 2:
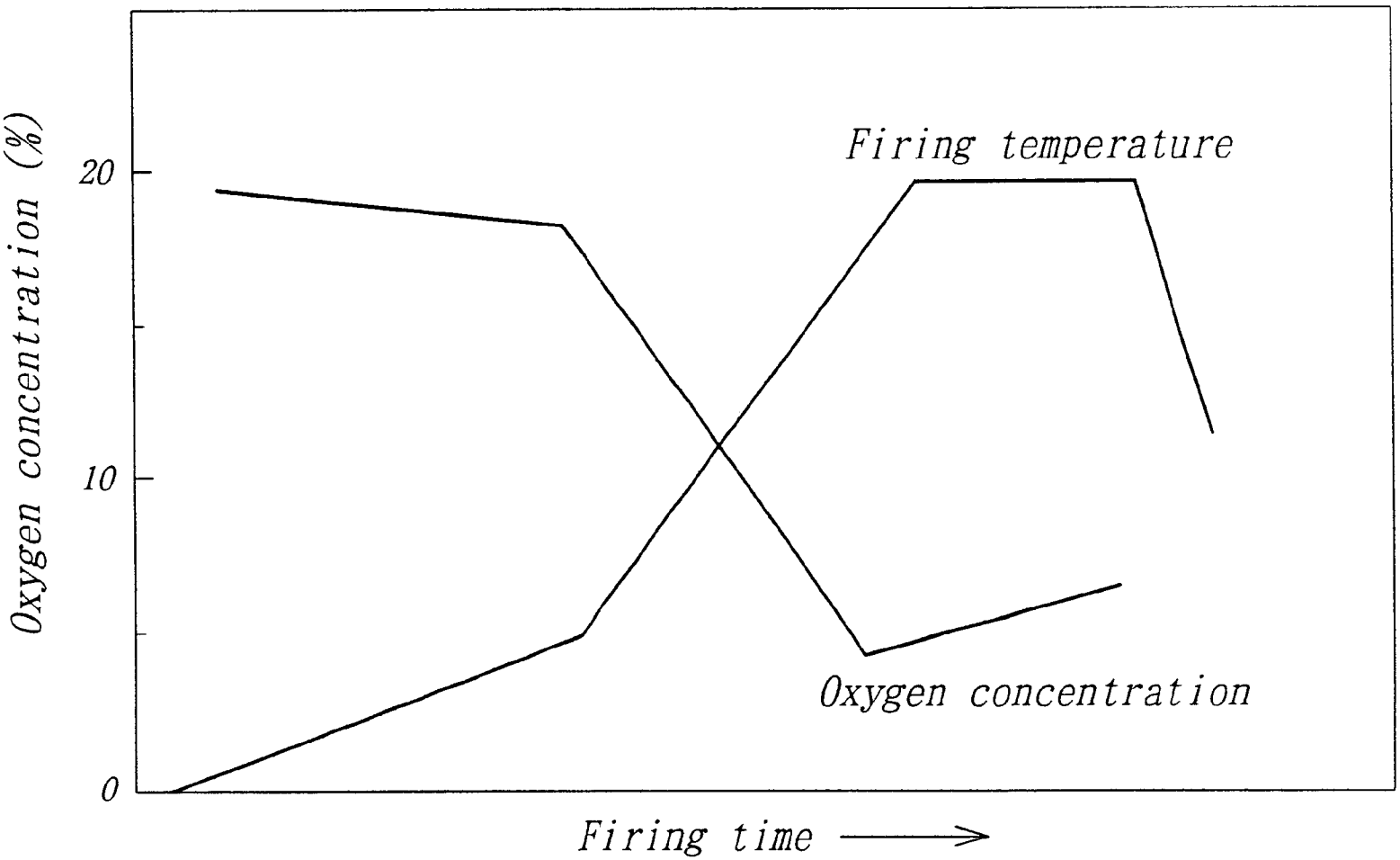
FIG. 2 is a graph showing changes in oxygen vs. time in a combustion furnace.

The temperature controller 15 is adapted to output, to the gas control valve 13, electric signals S responsive to temperature signals from the thermocouple 17 arranged inside the furnace and those from a firing temperature program generator 18. Therefore, if the electric signal X for the adjustment of the excess air volume remains zero, the temperature is controlled, while the theoretical air-fuel ratio is maintained. However, the concentration of oxygen needs to be largely varied in the batch-type combustion furnace during combustion as shown in FIG. 2. In view of this, according to the present invention, the electric signal X for the adjustment of the excess air volume, which is determined based on the concentration of oxygen in the furnace and an excess air volume required, is added to the signal S as mentioned later, thereby controlling the volume of air to be sent to the burner 10. In this manner, according to the present invention, since the air volume can be varied from a software side, the air-fuel ratio can be arbitrarily controlled over a wide range.

Figure 3:
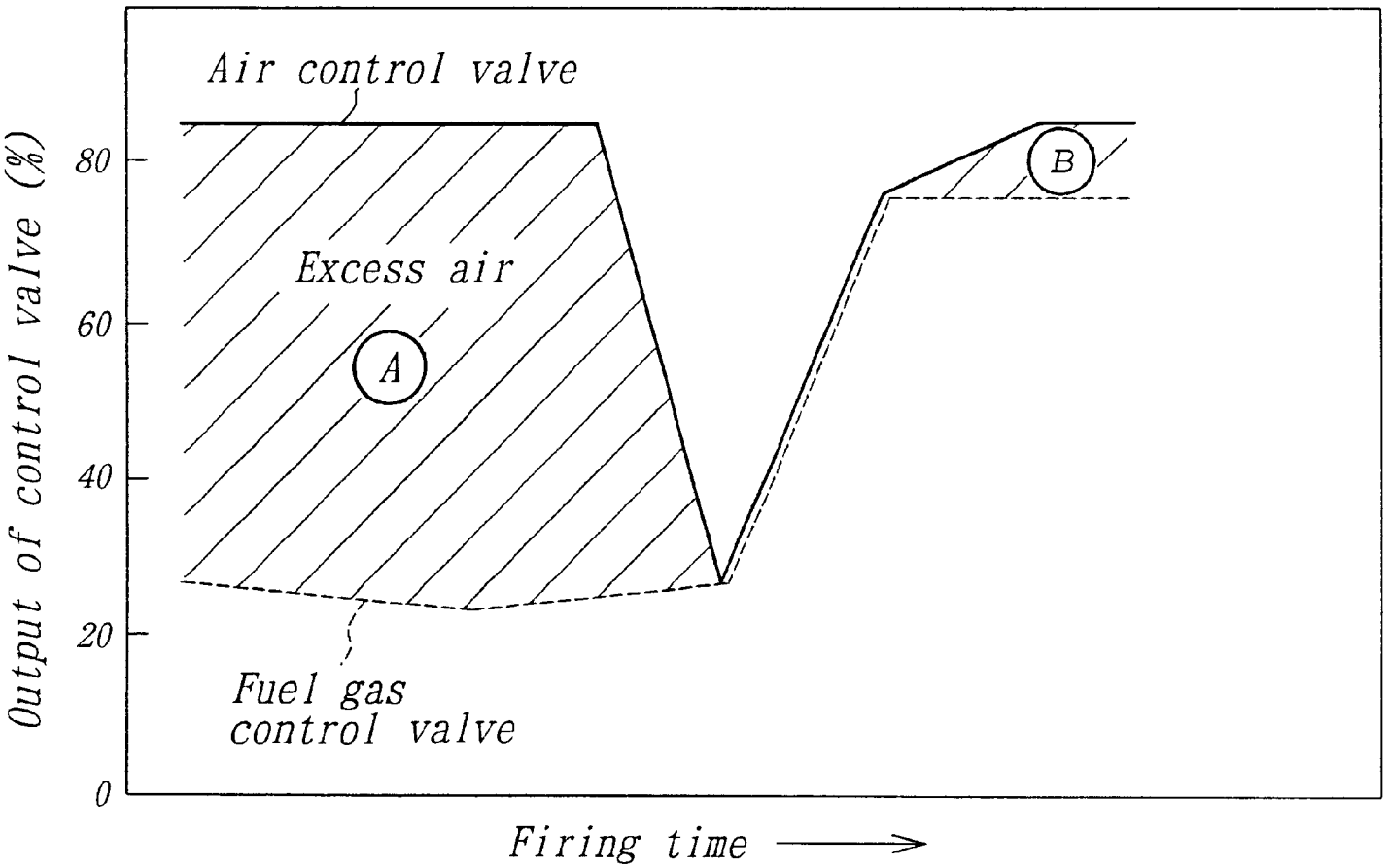
FIG. 3 is a graph showing outputs from control valves, respectively.

FIG. 2 shows the relationship among the lapse of time, the concentration of oxygen and the firing temperature schedule in the furnace, while FIG. 3 shows the working results obtained according to the temperature vs. the oxygen concentration schedule shown in FIG. 2, in which the shadowed portions denote output differences between the fuel gas and the air, i.e., the excess air amount.

An appropriate excess air amount required is determined based on the concentration of oxygen inside the furnace according to a specific program. Controlling can be made by either one of two systems. In one system, an output from the oxygen analyzer 22 is compared with the output from the oxygen concentration program 20 in an oxygen concentration controller 23, and if the oxygen concentration is not more than a target value, the excess air volume is increased, whereas if the oxygen concentration exceeds the target value, the excess air volume is decreased. In the other system, the excess air volume is determined by the excess air setting program 19 synchronized with the combustion time.

Figure 4:
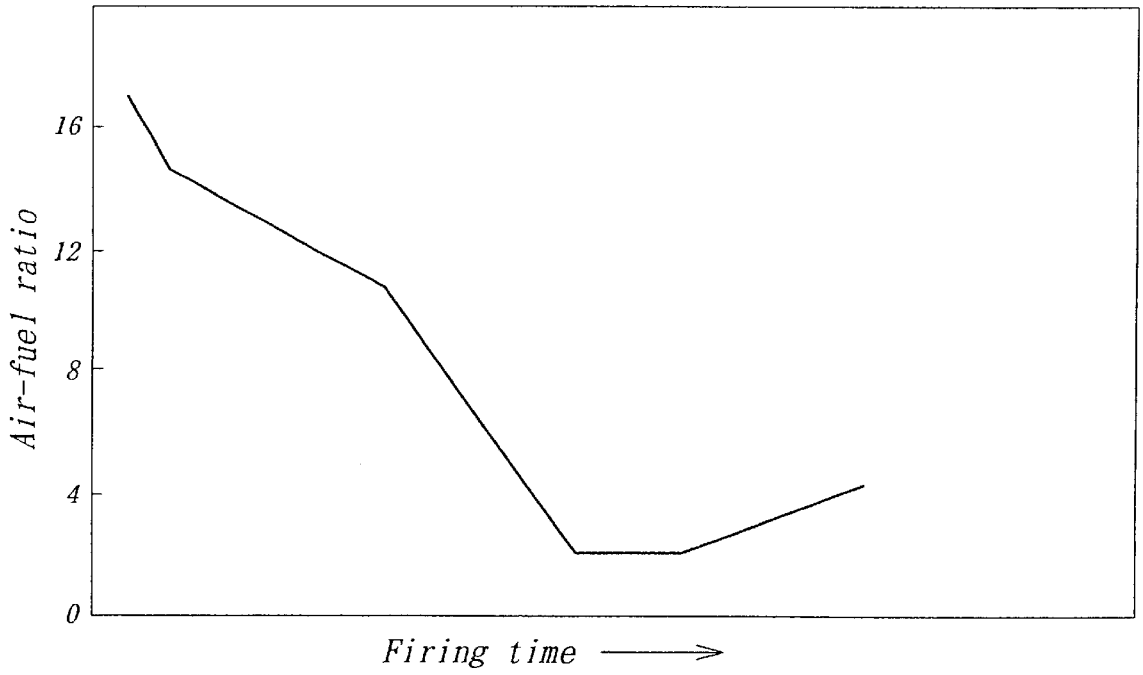
FIG. 4 is a graph showing changes in the air-fuel ratio vs. time.
Figure 5:
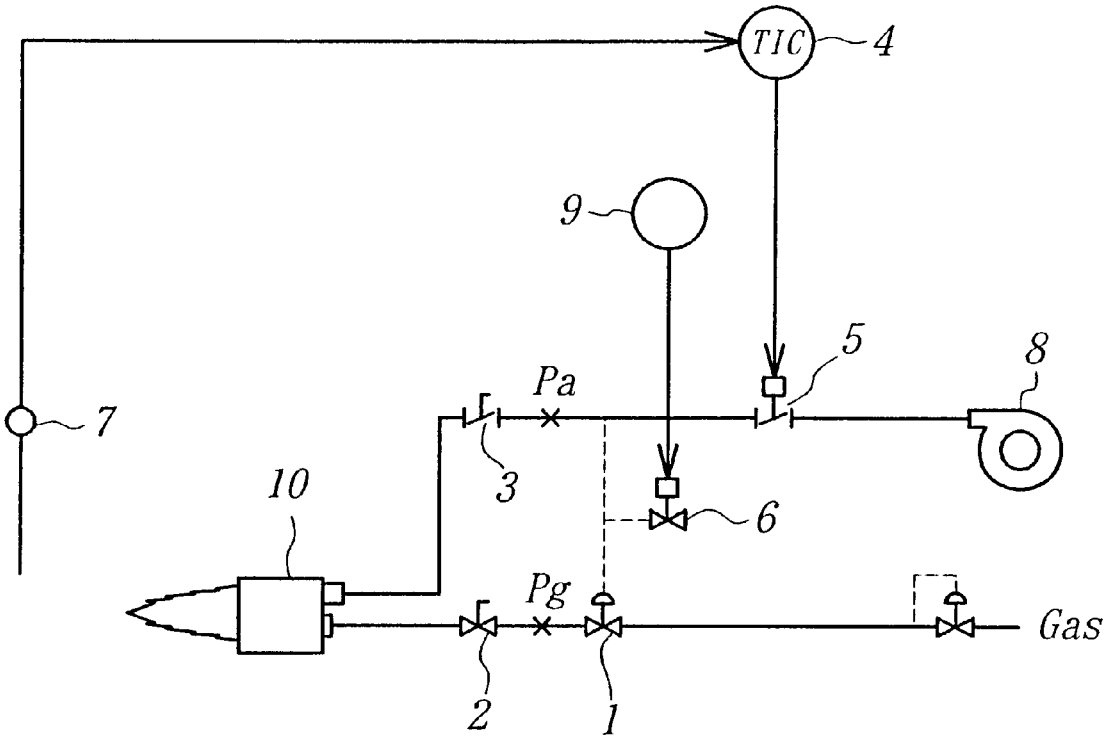
FIG. 5 PRIOR ART
FIG. 5 is a systematic control diagram in controlling the burner combustion in the conventional pressure-equalizing system.

As a result, the fuel gas control valve 13 controls the flow rate of the fuel gas responsive to the electric signal S from the temperature controller 15, whereas the air control valve 14 controls the flow rate of air responsive to the electric signal (S+X) in which the S is added with the electric signal X for the adjustment of the excess air volume. FIG. 3 shows output charts of the control valves, respectively, by way of example. As shown in this graph, excess air is fed in a low temperature area to lower the flame temperature through dilution with air. Excess air is also necessary to improve the diffusion of the fuel gas in the furnace (See "A" in FIG. 3). In the high temperature side (See "B" in FIG. 3), excess air functions to uniformly distribute the fuel gas in the furnace. As shown in FIG. 4, the air-fuel ratio "m" can be set at 10 or more. However, the output from the air control valve 14 does not go below that from the fuel gas control valve 13, so that the combustion will not occur at less than the theoretical air-fuel ratio.

The pressure of a combustion air blower 24 as the air source in the air pipeline 12 is varied according to the amount of air to be used, so that there is a possibility that the air-fuel ratio becomes unstable depending upon changes in the characteristics of the air control valve 14, such as collapse of the proportional relationship between the open degree and the flow rate of the air control valve. To cope with this, as shown in FIG. 1, it is preferable to control the suction control damper 26 by means of the pneumatic pressure controller 25 so that the air pressure of the suction control damper may be constantly controlled to always keep the detection values of the pressure sensor 27 constant.

Further, if the control valves 13, 14 are out of order owing to invasion of foreign matters or the like, unfavorable phenomena such as combustion at less than the theoretical air-fuel ratio occurs, resulting in serious troubles. For this reason, it is preferable that if a trouble signal is outputted from the fuel gas control valve 13 or the air control valve 14, combustion at the burner 10 is interrupted. That is, a trouble signal is inputted into the PLC from the control valve(s) 13, 14, so that the fuel gas line 11 is closed by the shut-down valve 29 receiving a shut-down signal from the PLC.

As having been explained above, according to the burner combustion-controlling method of the present inventions the system in which the fuel gas control valve is electrically linked with the air control valve is employed, and the air-fuel ratio is adjusted by the software. Therefore, the invention controlling method enables the air-fuel ratio to be controlled to as high as $\lambda=10$ or more, which has been impossible in the case of the conventional pressure-equalizing valve system. As compared with the conventional flow ratio control system, the invention control system can be constructed less expensively, so that combustion can be controlled independently for the respective burners. Therefore, the present invention is suitable for controlling the combustion of the burners in the batch-type combustion furnace which needs to control the air-fuel ratio over a wide range and strictly control the temperature distribution.

What is claimed is:

1. A method for controlling combustion of burners in a batch-type combustion furnace in which a fuel gas control valve is electrically linked to a corresponding air control valve for controlling each of said burners, said method comprising the steps of:

preliminarily affecting a flow range ratio adjusted with zero and span adjustments between the fuel gas control valve and the corresponding air control valve as to give a theoretical air-fuel ratio when the identical electric signals (S) from a temperature controller unit are given to the fuel gas control valve and the air control valve, inputting an electric signal (S) from the temperature controller unit to the fuel gas control valve to control an open degree of the fuel gas control valve, adding an electric signal (X) for adjusting an excess air volume to a same electrical signal (S) as that for the fuel gas control valve, and inputting the resulting electric signal obtained by said addition (X+S) to the air control valve to control an open degree of the air control valve, wherein the combustion of each of the burners is controlled.

2. The burner combustion-controlling method set forth in claim 1, wherein said electric signal (X) for adjusting an excess amount of air is determined based on the content of oxygen inside the furnace and an excess amount of oxygen required.

3. The burner combustion-controlling method set forth in claim 1 wherein a pressure of an air through an air source for feeding combustion air to the air control valve is controlled to a constant level.

4. The burner combustion-controlling method set forth in claim 1, wherein if a trouble signal is outputted from the fuel gas control valve or the air control valve, the combustion of the burner is interrupted.

5. The burner combustion-controlling method according to claim 1, wherein an appropriate excess air amount required is determined based on the concentration of oxygen inside the furnace according to (a) a system in which an output from an oxygen analyzer is compared with output from the oxygen concentration program in an oxygen concentration controller, and if the oxygen concentration is not more than a target value, the excess air amount is set to an increased value, whereas if the oxygen concentration exceeds the target value, the excess air amount is set to a decreased value or (b) a system in which the excess air amount is determined by an excess air setting program synchronized with a combustion time.

* * * * *